United States Patent [19]

Lim

[11] Patent Number: 4,981,217

[45] Date of Patent: Jan. 1, 1991

[54] UNITARY FOLDING SERVING TRAY

[76] Inventor: Edmond H. Lim, 1745 Walnut St., El Cerrito, Calif. 94530

[21] Appl. No.: 383,825

[22] Filed: Jul. 21, 1989

[51] Int. Cl.[5] ..... B65D 5/48

[52] U.S. Cl. ..... 206/561; 206/565; 224/42.46 R; 224/906; 229/1.5 H; 229/195; 229/904; 248/311.2

[58] Field of Search ..... 229/1.5 H, 904, 193, 229/195, 196; 206/561, 562, 565; 211/72, 73, 75, 88; 224/42.45 R, 42.46 R, 906; 248/311.2

[56] References Cited

U.S. PATENT DOCUMENTS

| | | | |
|---|---|---|---|
| 1,915,958 | 6/1933 | Skirrow | 224/42.46 R |
| 2,355,206 | 8/1944 | Davidson . | |
| 2,593,773 | 4/1952 | Levkoff | 229/193 |
| 2,670,124 | 2/1954 | Buchmiller . | |
| 2,695,712 | 11/1954 | Kolander | 206/561 |
| 2,794,585 | 6/1957 | Wagner | 206/561 |
| 2,803,390 | 8/1957 | Mackay | 224/906 |
| 2,926,834 | 3/1960 | Kaslow | 224/42.46 R |
| 3,031,162 | 4/1962 | Whorton | 248/311.2 |
| 3,128,984 | 4/1964 | Palm . | |
| 3,145,848 | 8/1964 | Wood . | |
| 3,189,247 | 6/1965 | Wischusen . | |
| 3,383,028 | 5/1968 | Brander | 229/195 |
| 3,425,543 | 2/1969 | Harvey | 229/195 |
| 3,722,781 | 3/1973 | Page . | |
| 3,730,419 | 5/1973 | Botterman . | |
| 4,156,484 | 5/1979 | Wischusen . | |
| 4,252,267 | 2/1981 | Osborne | 229/195 |
| 4,313,555 | 2/1982 | Sieffert | 229/195 |
| 4,489,879 | 12/1984 | Mode | 229/904 |
| 4,572,423 | 2/1986 | Spencer . | |
| 4,732,274 | 3/1988 | Bouton | 206/561 |

*Primary Examiner*—Gary E. Elkins

*Attorney, Agent, or Firm*—Townsend and Townsend

[57] ABSTRACT

A unitary folding serving tray (24) includes a base (4), first (6) and second (10) sidewalls and first (14) and second (18) end walls extending upwardly from the base and defining an interior region (42). The sidewalls are connected to the base along first (8) and second (12) fold lines. The first end wall is connected to the first sidewall along a third fold line (16). The base and a portion of the first sidewall extends outwardly past the first end wall to define a portion of the base having a drink container opening (46). The external base portion (44) is supported in a cantilevered fashion by a portion (48) of the first sidewall which also extends externally of the interior region. The end walls have downwardly extending hook like portions (34, 56) sized to permit the tray to be hung from the edge of a car window (40). The first sidewall is connected to the second end wall by hook and notch fastener elements (30,32).

25 Claims, 2 Drawing Sheets

UNITARY FOLDING SERVING TRAY

BACKGROUND OF THE INVENTION

Serving trays for holding food and beverages are commonplace. A typical example is shown in U.S. Pat. No. 3,722,781 to Page. This serving tray includes a bottom and a spaced apart top having appropriately sized openings. Two of the openings are sized for receipt of drink containers while the other relatively large opening is sized for receipt of other items, such as hamburgers, french fries and so forth.

These trays are usually disposable so that cost is a primary concern. Cost can be reduced in several ways, including making the trays fold flat for storage and shipment and by reducing, to the extent possible, the amount of material which must be used to accommodate the desired amount of food and beverages.

SUMMARY OF THE INVENTION

The present invention is directed to a unitary folding serving tray which can support both beverage containers and other items while minimizing the amount of material required for the tray.

The serving tray includes a base, first and second sidewalls extending upwardly from the base and first and second end walls coupled to the sidewalls and also extending upwardly from the base. The first and second sidewalls are connected to the base along first and second fold lines. The first end wall is connected to the first sidewall along a third fold line. The base extends outwardly past the first end wall to define an external portion of the base having an opening sized to accept a drink container. The external base portion is supported in a cantilevered fashion by a portion of the first sidewall which also extends externally of the interior region defined by the two sidewalls and two end walls.

The end walls preferably have downwardly extending hook like portions sized to permit the tray to be hung from the edge of an upwardly extending surface such as a partially rolled down car window.

The first sidewall may be connected to the second end wall through the use of a hook fastener element on the second end wall and a notch fastener element on the first sidewall. To facilitate engagement of the hook and notch fastener elements, the base is split or otherwise relieved to aid the upward deflection of the hook portion of the second end wall as the hook portion engages the notched portion of the first end wall.

A bottom support may be provided beneath the drink container open area in the base. The bottom support is an elongate member secured to either side of the open area. One end of the bottom support is connected to the bottom by a fold line while the other end is connected on the other side of the open area using a notch and tab arrangement. An elongate side support configured similarly to the bottom support can be formed from one or more of the side and end walls. One end of the side support is connected to one of the walls by a fold line while the other end has a tab which engages an appropriately shaped opening in one of the walls to define a container support region above the bottom of the tray.

One advantage of the invention results from extending a portion of the base external of the interior region of the tray; much less material is needed for the same capacity tray. The amount of material saved can be substantial, as much as forty percent.

Another advantage of the invention is the provision of extra wide slots adjacent the hooks formed on the end walls. Providing such extra wide slots permits the engagement of the hook and notch fastening elements and also permits the upper edge of a vertically oriented window to fit within the slot to suspend the tray from the window. This permits the slot to perform a dual purpose.

The use of elongate bottom supports connected by a fold line at one end and having the other end configured to engage an appropriately configured opening provides the necessary support for straight sided drink containers placed within the drink container open area. Of course such bottom supports are not necessarily needed when tapered sided cups are used.

In some case certain regions are subjected to higher than average forces. Such regions can be reinforced if desired. When corrugated material is used for the tray, strengthening pins sized to fit within a corrugated opening can be inserted into a corrugation opening at appropriate places on the tray.

At times it is desirable to secure, at least temporarily, the tray to a generally horizontal surface. To accommodate this the lower surface of the base may include an adhesive pad having an outer adhesive surface covered by a protective strip which can be peeled away to permit the tray to be secured in place.

Other features and advantages will appear from the following description in which the preferred embodiment has been set forth in detail in conjunction with the accompanying drawings.

DETAILED DESCRIPTION OF THE PREFERRED EMBODIMENT

Figure 1:
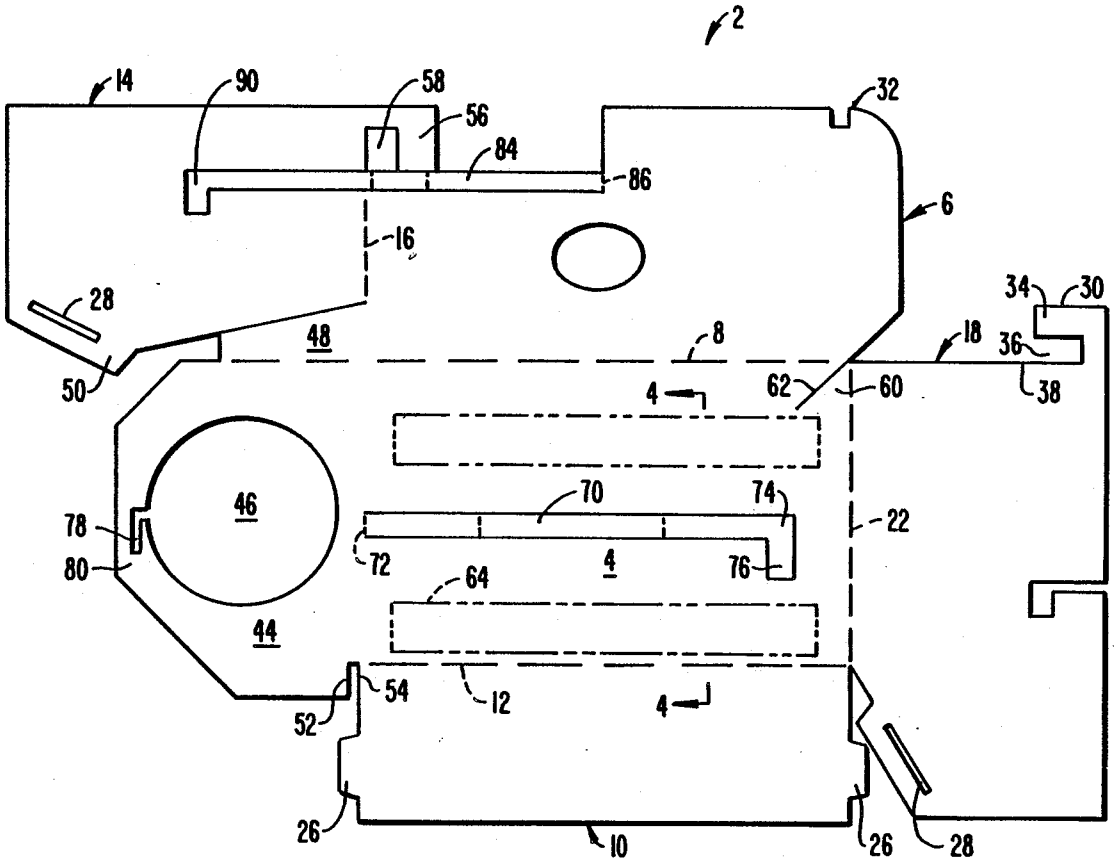
FIG. 1 is a plan view of blank from which a tray made according to the invention is made.

Referring now to FIG. 1 a tray blank 2 is shown to include a base 4 to which a first sidewall 6 extends along a first fold line 8. A second sidewall 10 extends from base 4 along a second fold line 12 on the opposite side of base 4 as first sidewall 6. A first end wall 14 extends from first sidewall 6 along a third fold line 16. Third fold line 16 is oriented generally perpendicularly to first fold line 8 but does not intersect fold line 8 for the purposes discussed below. A second end wall 18 extends from base 4 along fourth fold line 22. It should be noted that in FIG. 1 fold lines are shown as dashed lines while solid lines indicate portions which have been severed or substantially severed to be separable.

Figure 2:
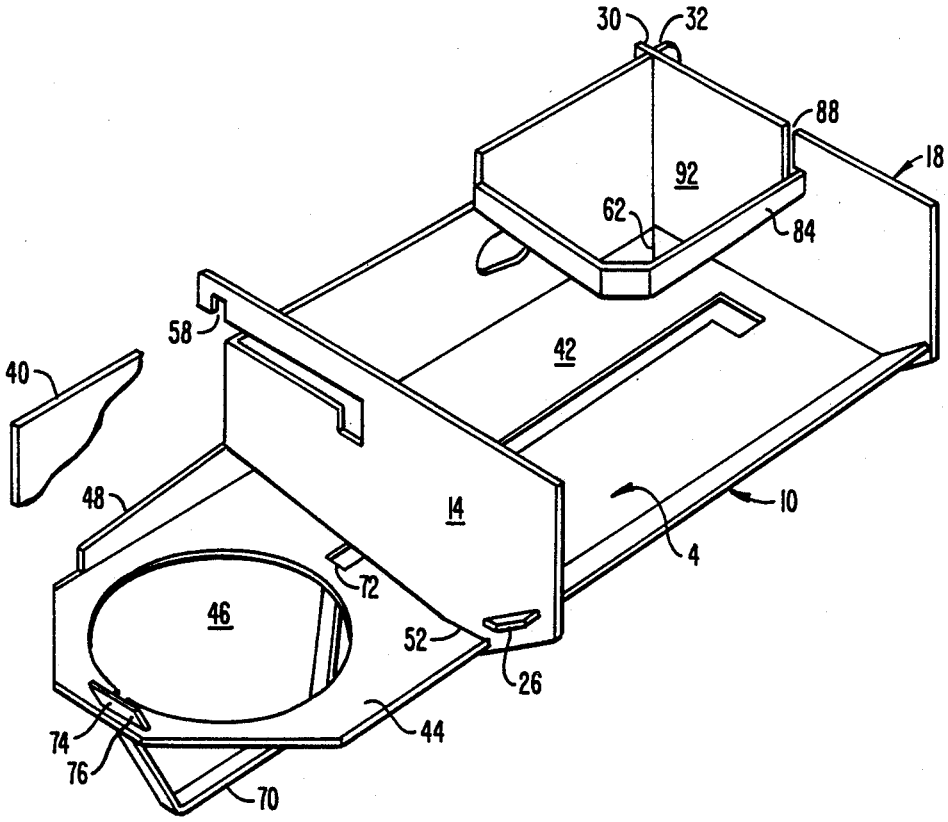
FIG. 2 is a perspective view of a tray made folding the tray blank of FIG. 1.
Figure 3:
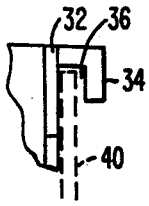
FIG. 3 is a partial side view of the tray of FIG. 2 shown engaging the upper edge of a window illustrated by dashed lines.

Referring now also to FIG. 2, a tray 24 is shown having been created from tray blank 2 by simply folding along the various fold lines and with various elements securing the walls together. In FIG. 2 the fold lines are shown as solid lines as is conventional. Second end wall 18 is secured to second sidewall 10 by the engagement of a tab 26 extending from second sidewall 10 with a slot 28 formed in second end wall 18. Second end wall 18 is secured to first sidewall 6 by the engagement of hook and notch fastening elements 30, 32. Hook fastening element 30 includes a downwardly extending hook 34 defining an enlarged slot 36 between hook 34 and the edge 38 of sidewall 18. The width of slot 36 is sized to accommodate the thickness of first sidewall 6 and to permit the upper edge of a vertically oriented surface such as an automobile window 40 as suggested in FIG. 3. First end wall 14 is secured to second sidewall 10 by the engagement of tab 26 and slot 28. Walls 6, 10, 14, 18 and base 4 define an interior region 42 for holding items such as food and beverages.

As can be seen in FIG. 2, base 4 includes an external base portion 44 which extends outwardly of first end wall 14 in a cantilevered fashion and has a drink container open area 46 formed therein. Vertical support of portion 44 is aided by the provision of an external portion 48 of first sidewall 6 which acts as a brace for portion 44. It should be noted that a portion 50 (see FIG. 1) of first end wall 14 is positioned between edges 52, 54 of external base portion 44 and second sidewall 10 respectively. This helps keep first end wall from pivoting away from second sidewall 10 thus keeping tab 26 and slot 28 engaged.

First end wall 14 also includes a hook 56 defining a slot 58 also sized to engage window 40 permitting tray 24 to be suspended from a partially rolled up automobile window or the like. It has been found that engaging hook and notch fastening elements 30, 32 is made difficult because of the resistance of base 4 at corner 60. To help alleviate this problem, a relief slit 62 is created in base 4 at corner 60 which permits the temporary deformation of base 4 at corner 60 to permit the easy engagement of hook and notch fastening elements 30, 32. After engaged, the resilient nature of base 4 tends to realign those portions of base 4 on either side of slit 62 to help keep elements 30, 32 engaged.

Figure 4:
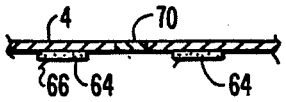
FIG. 4 is cross-sectional view of the base of the tray taken along line 4—4 of FIG. 1.

Tray 24 can also be used on a flat support surface. Sometimes, however, tray 24 may have a tendency to move about, such as when perched on an automobile dashboard. To help prevent this, a pair of adhesive pads 64 (see FIG. 4) each having a removable protective strip 66 which, when removed, exposes an adhesive surface so to permit tray 24 to be secured in place.

Base 4 includes a bottom support 70 formed from base 4 and extending from base 4 along a fifth fold line 72. An outer end 74 of bottom support 70 has an offset 76. Outer end 74 is secured to external base portion 44 by passing bottom support 70 adjacent end 74 into an L-shaped bottom support opening 78 so to retain end 74 with offset 76 overlying a region 80 adjacent the end of bottom support opening 78. Bottom support 70 is useful when straight sided containers are used or when tapered sided containers having diameters smaller than the diameter of open area 46 are used.

A side support 84 is created from first sidewall 6 and first end wall 14 as suggested in FIG. 1 and extends from a sixth fold line 86. Second end wall 18 has an L-shaped opening 88, similar to bottom support opening 78, for receipt of the offset outer end 90 of side support 84. When so engaged, side support 84, as shown in FIG. 2, creates a container support region 92, region 92 being a portion of interior region 42. Container support region 92 can be used to help position a drink container, a container of French fries or anything else which may have a tendency to fall over. Of course if not needed, side support 84 may remain as part of walls 6, 14.

To create tray 24 from blank 2, first sidewall 6 and second end wall 18 are folded along fold lines 8, 22 and deflected until hook and notch engagement elements 30, 32 become engaged. First end wall 14 is pivoted towards second sidewall 10 and both tabs 26 are guided into their respective slots 28. If either or both bottom supports 70 or side support 84 are to be used, respective supports are removed with their respective outer ends 74, 90 engaged with respective openings 78, 88. If tray 24 is to be used supported on the top edge of a window 40, the edge is inserted into slots 36, 58 so to suspend tray 24 from the window. If tray 24 is to be placed upon a horizontal or inclined support surface, and if it is desired to keep tray 24 from slipping, at least temporarily, protective strips 66 may be removed from one or both pads 64 prior to placing tray 24 on such surface.

Modification and variation can be made to the disclosed embodiment without departing from the subject of the invention as defined in the following claims. For example, first end wall 14 could extend from second sidewall rather than first sidewall and be attached to first sidewall 6 through hook and notch fastening elements similar to elements 30, 32. Also, two external base portions 44 could be provided; in such case second end wall 18 would be configured similar to first end wall 14. Rather than having pads 64 be adhesive, portions of the lower surface of base 4 could be covered with a tacky or otherwise non-slip material to help keep tray 4 from slipping on its support surface. Other type of connection elements can be used to secure the walls to one another.

What is claimed is:

1. A unitary folding serving tray comprising:
a base;
a first sidewall extending upwardly from the base along a first fold line;
a second sidewall extending upwardly from the base along a second fold line opposite the first sidewall;
first and second end walls extending upwardly from the base to define an interior region among the sidewalls, the end walls and the bottom;
the first end wall extending from the first sidewall along a third fold line;
the second end wall extending from one of the first sidewall, the second sidewall and the base along a fourth fold line;
means for securing the sidewalls and end walls together to maintain their upwardly extending orientations defining said interior;
the base and the first sidewall each including a portion positioned external of the interior and joined to one another along the first fold line;
the base portion including an open area sized for receipt of a container so the container can be supported by the base and first sidewall portions external of the interior; and
the first sidewall portion extending transversely to the base portion to act as a support for the base portion to help support the container.

2. The tray of claim 1 wherein the base is substantially flat.

3. The tray of claim 1 wherein the first sidewall extends generally perpendicularly from the base.

4. The tray of claim 1 wherein the second sidewall extends from upwardly and outwardly from the base.

5. The tray of claim 1 wherein the base portion is coplanar with the base.

6. The tray of claim 1 wherein the first sidewall portion is coplanar with the first sidewall.

7. The tray of claim wherein the fourth fold line joins the base and the second end wall.

8. The tray of claim 7 wherein the securing means includes notch and hook fastener elements formed on the first sidewall and the second end wall.

9. The tray of claim 8 wherein the first sidewall includes the notch fastener element.

10. The tray of claim 8 further comprising means for aiding deflection of the base at a corner region adjacent the first sidewall and the second end wall during engagement and disengagement of the notch and hook fasteners.

11. The tray of claim 10 wherein the deflection aiding means includes a slit formed in the base.

12. The tray of claim 1 wherein the first and second end walls include hook portions extending external of the interior and adjacent the first sidewall, said hook portions sized to engage an upper edge of an upwardly extending support member so to suspend the tray from the support member.

13. The tray of claim 12 wherein:

the fourth fold line joins the base and the second end wall;

the securing means includes a notch fastener element formed on the first sidewall; and the hook portion of the second end wall being sized and positioned to engage the notch fastener element.

14. The tray of claim 1 wherein the open area is circular.

15. The tray of claim 1 further comprising a bottom support connected to the base and positioned beneath the open area to provide vertical support for the container positioned therein.

16. The tray of claim 15 wherein the bottom support extends from the base along a fifth fold line.

17. The tray of claim 16 wherein the bottom support includes an offset end and the bottom includes a bottom support opening with which said offset end engages.

18. The tray of claim 1 further comprising a side support positioned over the base and having first and second ends extending from the sidewalls, the first end extending from a sixth fold line, the second end removably secured to one of the sidewalls and the end walls, whereby the side support at least partially defines a container support portion of the interior region and provides lateral support to a container supported by the base and positioned within the container support region.

19. The tray of claim 1 wherein the base includes a lower surface, and further comprising a releasable securement element on the lower surface adapted to secure the tray to a support surface.

20. The tray of claim 19 wherein the securement element includes an adhesive pad having a peel off protective strip removably covering an adhesive pad surface.

21. A unitary folding serving tray comprising:

a base;

a first sidewall extending upwardly from the base along a first fold line;

a second sidewall extending upwardly from the base along a second fold line opposite the first sidewall;

first and second end walls extending upwardly from the base to define an interior region among the sidewalls, the end walls and the bottom;

the first end wall extending from the first sidewall along a third fold line;

the second end wall extending from one of the first sidewall, the second sidewall and the base along a fourth fold line;

means for securing the sidewalls and end walls together to maintain their upwardly extending orientations defining said interior, the securing means including notch and hook fastener elements formed on the first sidewall and the second end wall, the first sidewall including the notch fastener element; and means for aiding (deflection) of the base at a corner region adjacent the first sidewall and the second end wall during engagement and disengagement of the notch and hook fasteners.

22. The tray of claim 21 wherein the deflection aiding means includes a slit formed in the base.

23. A unitary folding serving tray comprising:

a base;

a first sidewall extending upwardly from the base along a first fold line;

a second sidewall extending upwardly from the base along a second fold line opposite the first sidewall;

first and second end walls extending upwardly from the base to define an interior region along the sidewalls, the end walls and the bottom;

the first end wall extending from the first sidewall along a third fold line;

the second end wall extending from one of the first sidewall, the second sidewall and the base along a fourth fold line, the fourth fold line joining the base and the second end wall;

means for securing the sidewalls and end walls together to maintain their upwardly extending orientations defining said interior;

the first and second end walls including hook portions extending external of the interior and adjacent the first sidewall, said hook portions sized to engage an upper edge of an upwardly extending support member so to suspend the tray from the support member;

the securing means includes a notch fastener element formed on the first sidewall; and the hook portion of the second end wall being sized and positioned to engage the notch fastener element.

24. A unitary folding serving tray comprising:

a base including an open area;

a first sidewall extending upwardly from the base along a first fold line;

a second sidewall extending upwardly from the base along a second fold line opposite the first sidewall;

first and second end walls extending upwardly from the base to define an interior region among the sidewalls, the end walls and the bottom;

the first end wall extending from the first sidewall along a third fold line;

the second end wall extending from one of the first sidewall, the second sidewall and the base along a fourth fold line;

means for securing the sidewalls and end walls together to maintain their upwardly extending orientations defining said interior; and a bottom support, extending from the base along a fifth fold line, connected to the base and positioned beneath the open area to provide vertical support for a container positioned therein.

25. The tray of claim 24 wherein the bottom support includes an offset end and the bottom includes a bottom support opening with which said offset end engages.

* * * * *